US005738509A

United States Patent [19]

Marling et al.

[11] Patent Number: 5,738,509

[45] Date of Patent: Apr. 14, 1998

[54] PREMIX BURNER HAVING AXIAL OR RADIAL AIR INFLOW

[75] Inventors: Tino-Martin Marling, Filderstadt-Bernhausen, Germany; Burkhard Schulte-Werning, Basel; Thomas Zierer, Ennetbaden, both of Switzerland

[73] Assignee: Asea Brown Boveri AG, Baden, Switzerland

[21] Appl. No.: 615,803

[22] Filed: Mar. 14, 1996

[30] Foreign Application Priority Data

May 8, 1995 [DE] Germany ..... 195 16 798.8

[51] Int. Cl.[6] ..... F23D 14/46

[52] U.S. Cl. ..... 431/352; 431/173; 431/284; 431/187

[58] Field of Search ..... 431/352, 8, 173, 431/284, 354, 285, 187

[56] References Cited

FOREIGN PATENT DOCUMENTS

| | | |
|---|---|---|
| 0321809B1 | 6/1989 | European Pat. Off. . |
| 1401835 | 10/1968 | Germany . |
| 2538512 | 3/1976 | Germany . |
| 2653410 | 6/1977 | Germany . |
| 2119077 | 11/1983 | United Kingdom . |
| WO92/16798 | 10/1992 | WIPO . |
| 0518072A1 | 12/1992 | WIPO . |
| WO92/21919 | 12/1992 | WIPO . |

*Primary Examiner*—Larry Jones

*Attorney, Agent, or Firm*—Burns, Doane, Swecker & Mathis, L.L.P.

[57] ABSTRACT

In a premix burner (18) having axial or radial air inflow, in which premix burner (18) the combustion air (15) flows out of a plenum (27), arranged before or around the burner (18), into the burner (18) and fuel (12, 13) is mixed with it on the way through the burner (18), a perforated component (24) having a wall thickness (s) and openings (25) of in each case a diameter (d) and at a distance (t) apart is arranged between the plenum (27) and the burner (18), which component (24) splits the combustion air (15) flowing through into small defined jets which reunite after a certain running length (l), the ratio of wall thickness (s) to the diameter (d) of the openings (25) being greater than/equal to one, and the ratio between the through-flow area of the component (24) and the possible inflow area to the burner (18) being greater than/equal to one as a function of the type of burner.

8 Claims, 5 Drawing Sheets

FIG. 8
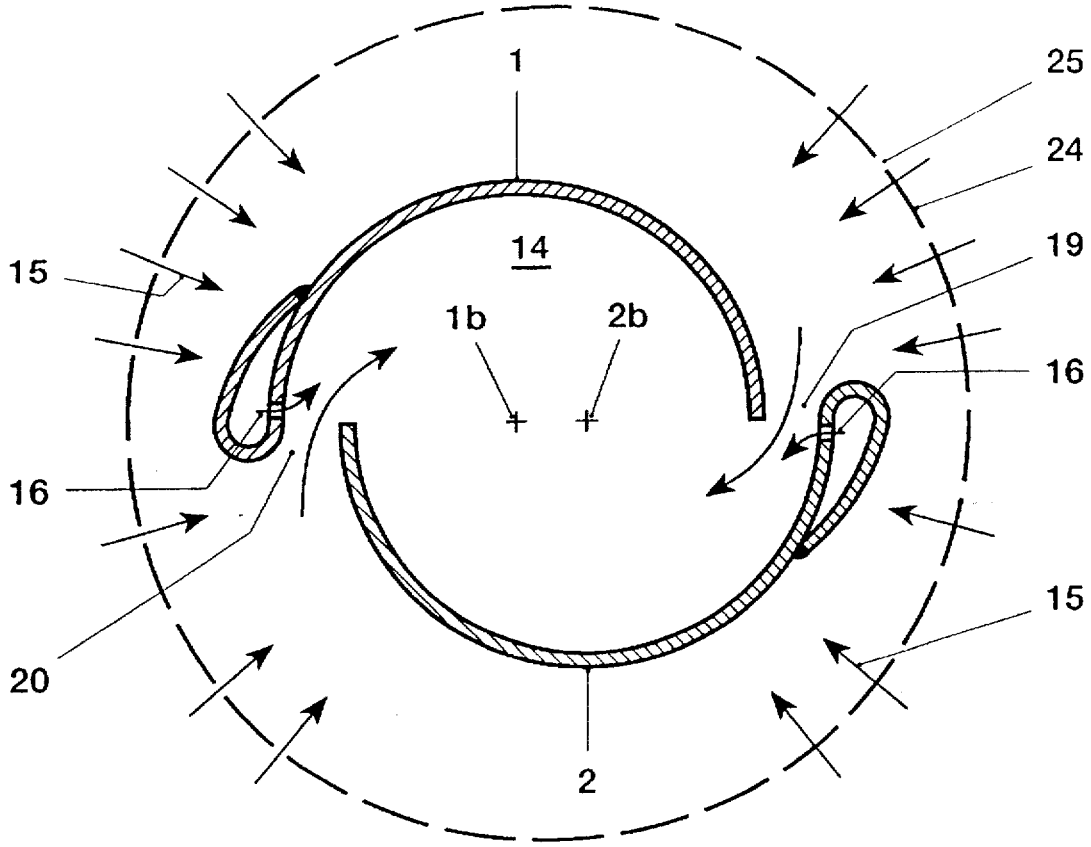
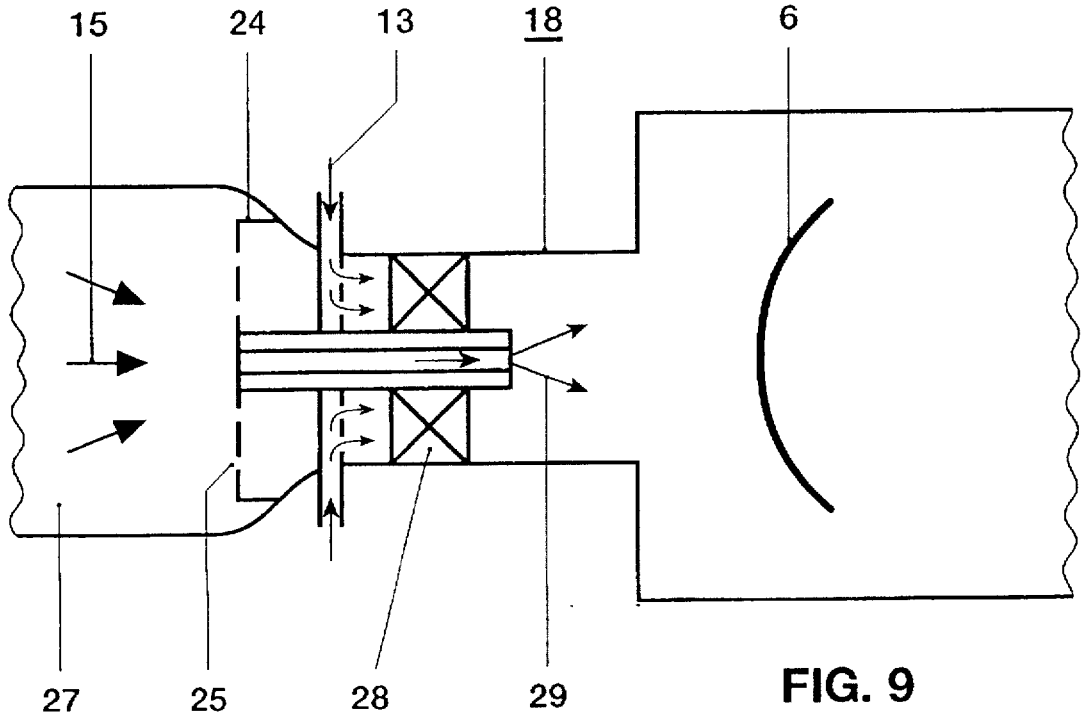
FIG. 9

PREMIX BURNER HAVING AXIAL OR RADIAL AIR INFLOW

BACKGROUND OF THE INVENTION

1. Field of the Invention

The invention relates to a premix burner having axial or radial air inflow for gas-turbine operation, in which premix burner the combustion air flows out of a plenum into the burner and fuel is mixed with it on the way through the burner.

2. Discussion of Background

For reasons of environmental protection, modern burner systems used in gas-turbine plants are designed as premix burners, since the pollutant emission values are thereby significantly reduced compared with diffusion burners. As a rule the premix burners are subjected to an axial or radial flow of combustion air.

Fuel is mixed with the air flow on the way through the burner. In order to achieve low NOx and CO emission values during the combustion, homogeneous intermixing of fuel and air is necessary, i.e. the addition of fuel is to be adapted to the air distribution. So that this continues to be ensured in all cases, the air feed should be controllable. However, that is not the case in the premix burner systems.

In the premix burner of the double-cone type of construction disclosed by U.S. Pat. No. 4,932,861 to Keller et al., the combustion air flows out of a plenum, surrounded by a hood, via tangential air-inlet slots into the interior space of the burner. If gaseous fuel is burned, the mixture is formed directly at the end of the air-inlet slots. During the injection of liquid fuel through a nozzle arranged centrally in the initial part of the burner, a conical liquid-fuel column which is enclosed by a combustion-air flow passing tangentially into the burner is formed in the interior space of the burner. The mixture is ignited at the outlet of the burner, the flame being stabilized by a backflow zone in the region of the burner orifice. The burner is not subjected to uniform flow owing to the complex flow situation in the hood, which results from the fact that both the cooling air which has cooled the combustion chamber and additional air via a bypass flows into the hood, a factor which leads to vorticity. The feeding of the combustion air cannot be controlled exactly, so that no completely homongeneous intermixing of fuel and air is achieved. This in turn leads to increased pollutant emissions during the combustion.

SUMMARY OF THE INVENTION

Accordingly, one object of the invention, in attempting to avoid all these disadvantages, is to provide in a premix burner a novel device for rectifying the flow, with which device the flow profile of the inflowing combustion air is evened out, the intensity of the turbulence increases and the air flow can be adapted to the burner so that homongeneous intermixing of air and fuel is achieved.

According to the invention, in a premix burner having axial or radial air inflow, in which premix burner the combustion air flows out of a plenum, arranged in the direction of flow before or around the burner, into the burner and fuel is mixed with it on the way through the burner, this is achieved when a perforated component having a certain wall thickness and openings of a certain diameter and at a certain distance apart is arranged between the plenum and the burner, which component splits the combustion air flowing through into small defined jets which reunite after a certain running length, the ratio of wall thickness to the diameter of the openings being greater than/equal to one, preferably 1.5, and the ratio between the through-flow area of the perforated component and the possible inflow area to the burner being greater than/equal to one as a function of the type of burner.

The advantages of the invention consist, inter alia, in the fact that a uniform velocity profile having an increased turbulence level is obtained as inflow for the burner after the perforated component. The mixing of fuel and combustion air is thereby improved and intensified, so that the emission values of CO and NOx are reduced. The premix burners have a greater range of use, since they may now also be readily operated even under unfavorable imposed flow conditions.

It is advantageous if the perforated component is a perforated basket arranged around the burner in the case of a premix burner having radial air inflow and a wall arranged in front of the burner perpendicularly to the direction of flow of the combustion air in the case of a burner having axial air inflow.

It is especially expedient if the ratio of running length to the distance between the openings is greater than/equal to 5.

Furthermore, it is advantageous if, in the case of a premix burner subjected to axial flow, the ratio between the through-flow area of the perforated wall and the inflow area to the burner is equal to one.

Finally, it is of advantage, in the case of a premix burner of the double-cone type of construction according to U.S. Pat. No. 4,932,861 to Keller et al., in which the combustion air flows via tangential air-inlet slots into the burner, if the ratio between the through-flow area of the perforated basket and the inflow area to the burner is greater than one, preferably four. This ensures that a non-uniform air distribution along the inflow length of the burner can be rectified in terms of both mass distribution and flow profile. Consequently, the fuel can be optimally proportioned along the air-inlet slot, so that the mixing of fuel and air is improved and the NOx values are reduced during the combustion.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein two exemplary embodiments of the invention are shown with reference to a premix burner of the double-cone type of construction subjected to radial flow for gas-turbine combustion chambers and with reference to a premix burner subjected to axial flow and wherein:

FIG. 8 shows a section in the plane VIII—VIII according to FIG. 6;

FIG. 9 shows a partial longitudinal section of a premix burner subjected to axial flow and having a flow rectifier.

Only the elements essential for understanding the invention are shown, thus the combustion chamber, for example, is only indicated. The direction of flow of the air is designated by arrows.

DESCRIPTION OF THE PREFERRED EMBODIMENTS

Figure 1C:
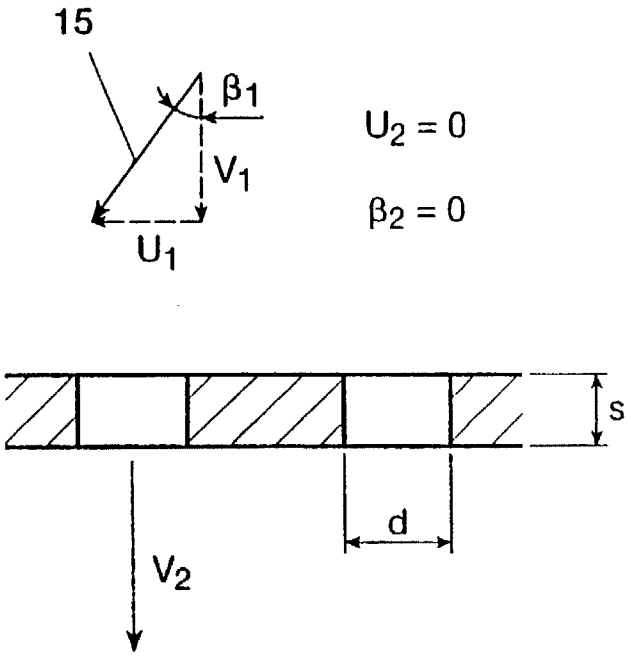
FIG. 1*c* shows a schematic representation of the velocity function of the inflowing air when flow is imposed at an angle.
Figure 1B:
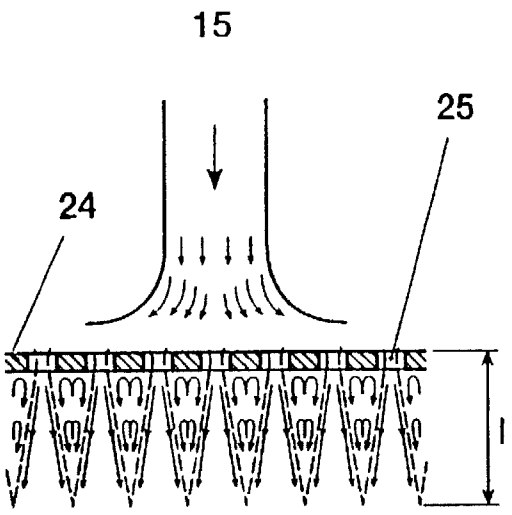
FIG. 1*b* shows the flow profile in the case of non-uniform inflow of the air via a perforated wall.
Figure 1A:
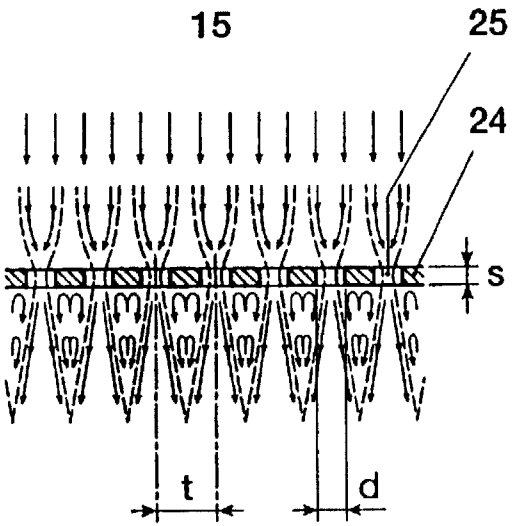
FIG. 1*a* shows the flow profile in the case of uniform inflow of the air via a perforated wall.

Referring now to the drawings, wherein like reference numerals designate identical or corresponding parts throughout the several views, FIG. 1*a* first of all generally shows the mode of operation of the perforated component 24, acting like a flow rectifier, in the case of an ideal uniform inflow of the air 15, whereas in FIB. 1*b* the mode of operation of the perforated component 24 in the case of a non-uniform inflow of the air 15 is shown.

The component 24 with a small wall thickness s has a number of openings 25 of in each case a diameter d. These openings 25 are arranged at a constant distance t from one another. According to FIGS. 1*a* and 1*b*, the air 15 flowing through the openings 25 of the component 24 is split up into small defined jets which reunite behind the bore after a certain running length l. Here, the running length l depends on the distance t and the diameter d of the openings 25 as well as on the jet divergence. As readily apparent from FIG. 1*b*, the jet expansion is already effected before the perforated component in the case of a non-uniform inflow. After flow occurs through the wall, a uniform velocity profile having an increased small-scale turbulence level is produced, which leads to a favorable inflow for the burner (not shown in FIG. 1).

In addition, in the case of curved walls, for example in the case of a perforated basket placed around the burner, a constant discharge angle of the flow from the basket may be predetermined and thus adapted to the burner.

FIG. 1*c* shows a schematic representation of the velocity function of the inflowing air when the perforated component 24 is subjected to flow at an angle. Before the air 15 strikes the component 24, its velocity is composed of a vertical component $v_1$ here and a horizontal component $u_1$, an angle $\beta_1$ being enclosed by the resultant velocity 15 and $v_1$. After flow occurs through the component, which has a fixed minimum ratio of wall thickness s to hole diameter d, the horizontal component $u_2$ and the angle $\beta_2$ are zero, so that there is only a vertical velocity component $v_2$, where $v_1<v_2$. On the other hand, if a perforated component 24 having a very small wall thickness is used, the horizontal velocity component $u_1$ is retained and $u_2=u_1$ and $\beta_2<\beta_1$, while the vertical velocity component $v_2$ after the component 24 is likewise greater than $v_1$. In this case, no flow rectification takes place.

With regard to the design of the perforated component 24, a fixed area ratio between the through-flow area of the component and the inflow area to the premix burner is to be maintained. This is because the pressure loss across the perforated component 24 is determined by these two areas. Likewise, the ratio between the diameter d of the openings 25 and the wall thickness s must not fall below a fixed value, since this ratio also determines the level of the pressure loss. It has been found that the ratio d/s should be equal to at least one and preferably 1.5. These requirements establish the distance t between the openings 25, which in turn determines the flow profile behind the component 24, since the ratio l/t should be $l/t \geqq 5$, for the individual jets have then coalesced again on account of the jet divergence and the velocity profile is very uniform.

Figure 2:
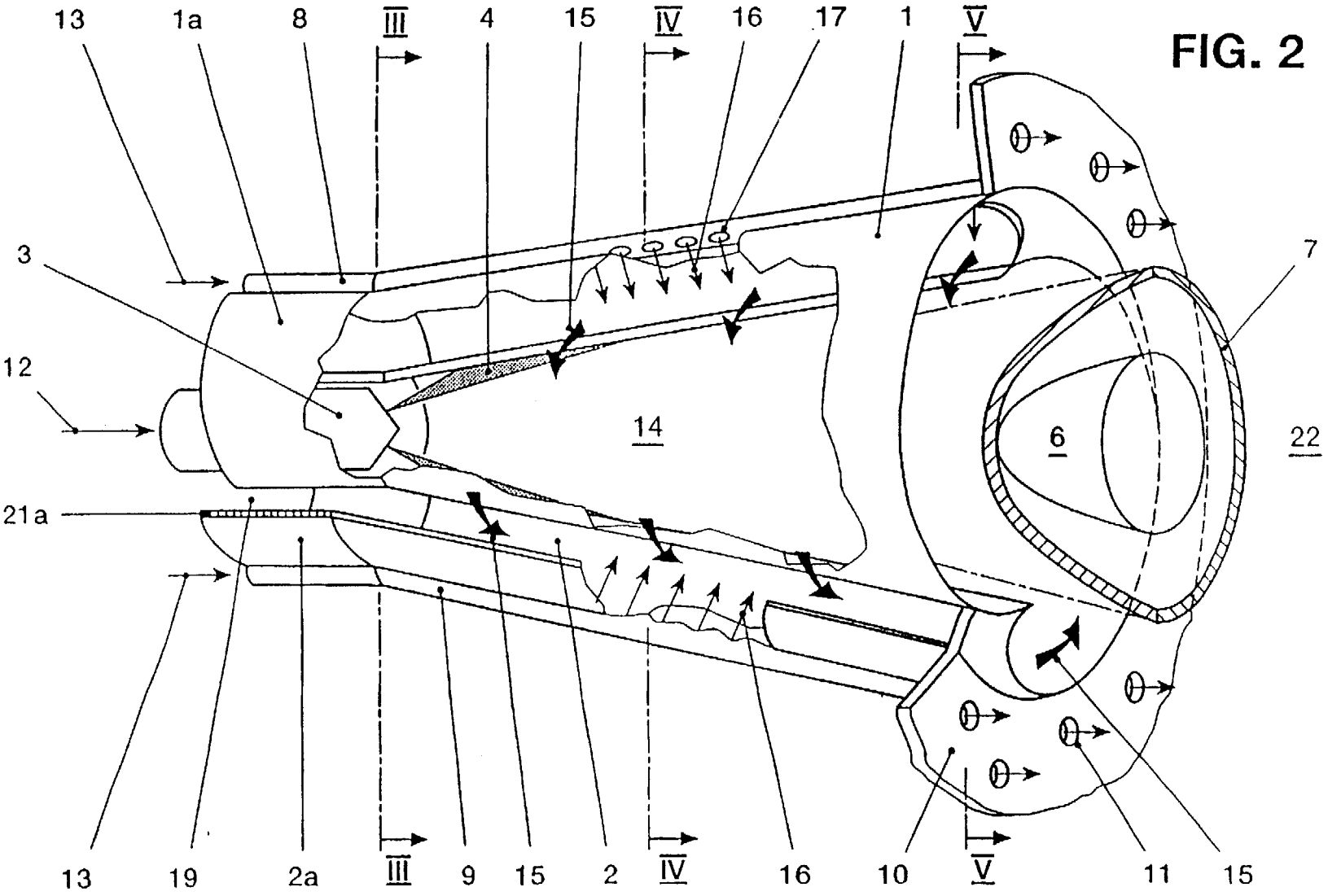
FIG. 2 shows a premix burner of the double-cone type of construction in perspective representation.
Figure 3:
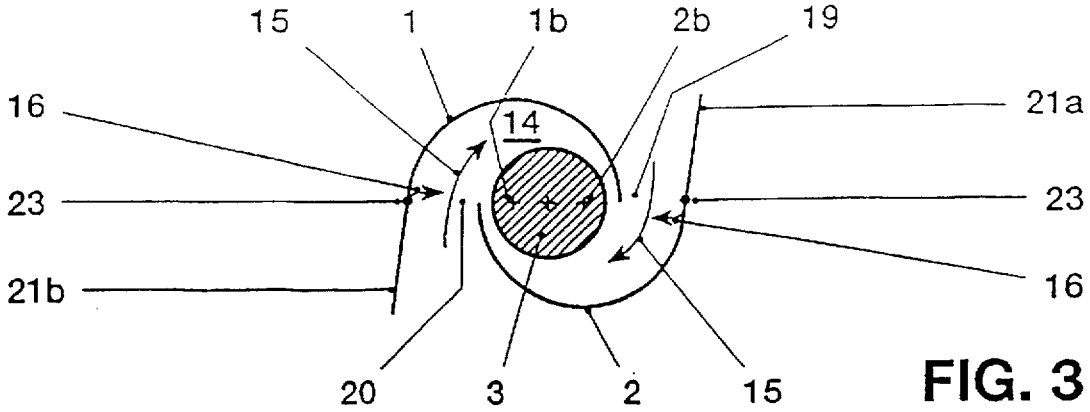
FIG. 3 shows a simplified section in the plane III—III according to FIG. 2.
Figure 4:
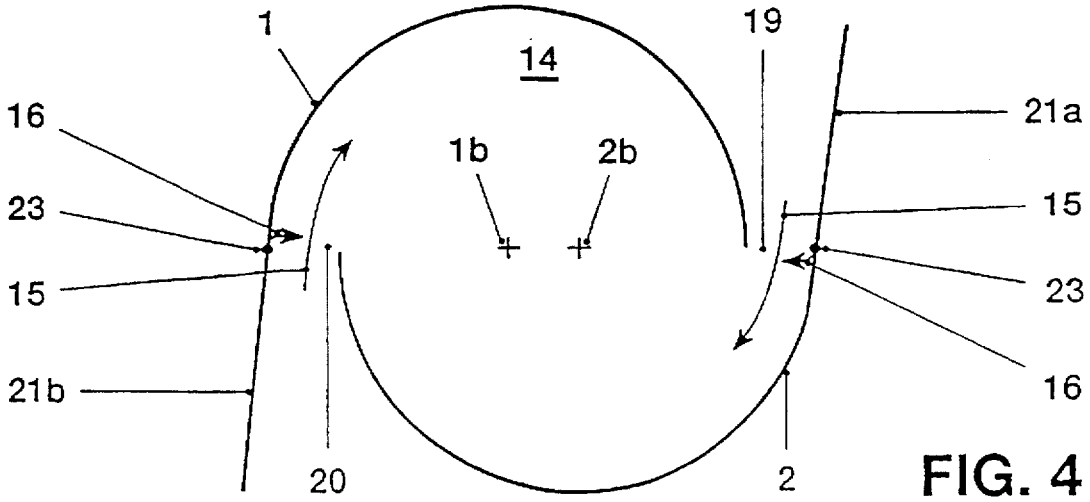
FIG. 4 shows a simplified section in the plane IV—IV according to FIG. 2.
Figure 5:
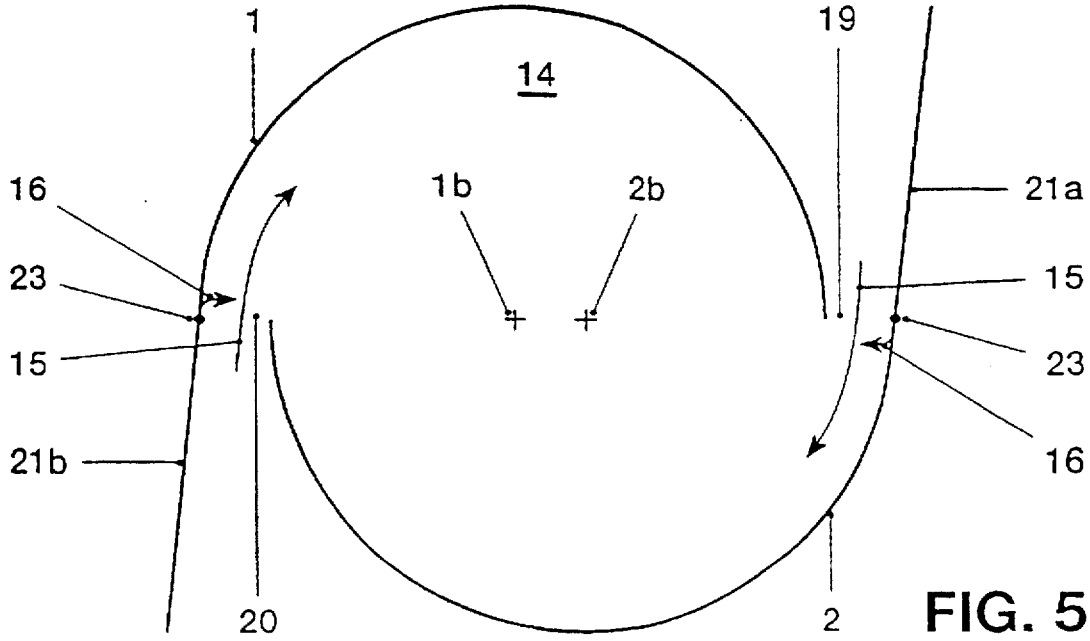
FIG. 5 shows a simplified section in the plane V—V according to FIG. 2.

FIG. 2, as an exemplary embodiment of the invention in perspective representation, shows a burner 18 of the double-cone type of construction having an integrated premix zone, the basic construction of which is described in U.S. Pat. No. 4,932,861 to Keller et al. To better understand the burner construction it is advantageous if FIG. 2 and the sections apparent therein according to FIGS. 3 to 5 are used at the same time.

The burner 18 comprises two sectional cone bodies 1, 2 which are radially offset from one another with regard to their longitudinal symmetry axes 1*b*, 2*b*. Tangential air-inlet slots 19, 20 are thereby obtained in each case in an opposed inflow arrangement on both sides of the sectional cone bodies 1, 2, through which air-inlet slots 19, 20 the combustion air 15 flows into the interior space 14 of the burner 18, i.e. into the conical hollow space formed by the two sectional cone bodies 1, 2. The sectional cone bodies 1, 2 widen rectilinearly in the direction of flow, i.e. they are at a constant angle to the burner axis. The two sectional cone bodies 1, 2 each have a cylindrical initial part 1*a*, 2*a*, which parts likewise run offset. Located in this cylindrical initial part 1*a*, 2*a* is an atomization nozzle 3, the openings of which are arranged approximately in the narrowset cross-section of the conical interior space 14 of the burner 18. The burner 18 may of course also be designed without a cylindrical initial part, that is, it may be designed to be purely conical. Liquid fuel 12 is injected through the nozzle 3 so that a droplet spray 4 forms in the interior space 14 of the burner 18.

The two sectional cone bodies 1, 2 each have a fuel feed line 8, 9 along the air-inlet slots 19, 20, which fuel feed lines 8, 9 are provided on the longitudinal side with openings 17 through which a further fuel 13 flows. This gaseous fuel 13 is mixed with the combustion air 15 flowing through the tangential air-inlet slots 19, 20 into the interior space 14 of the burner, which is shown by the arrows 16. Mixed operation of the burner 18 via the nozzle 3 and the fuel feeds 8, 9 is possible. In addition, this air feed ensures that flame stabilization takes place at the outlet of the burner. A stable flame front 7 having a backflow zone 6 appears there.

Arranged on the combustion-space side is a front plate 10 having openings 11 through which diluent air or cooling air is fed to the combustion space 22 when required.

The arrangement of baffle plates 21*a*, 21*b* can be gathered from FIGS. 3 to 5. They can be opened and closed, for example, about a pivot 23 so that the original gap size of the tangential air-inlet slots 19, 20 is thereby changed. The burner may of course also be operated without these baffle plates 21*a*, 21*b*.

Figure 6:
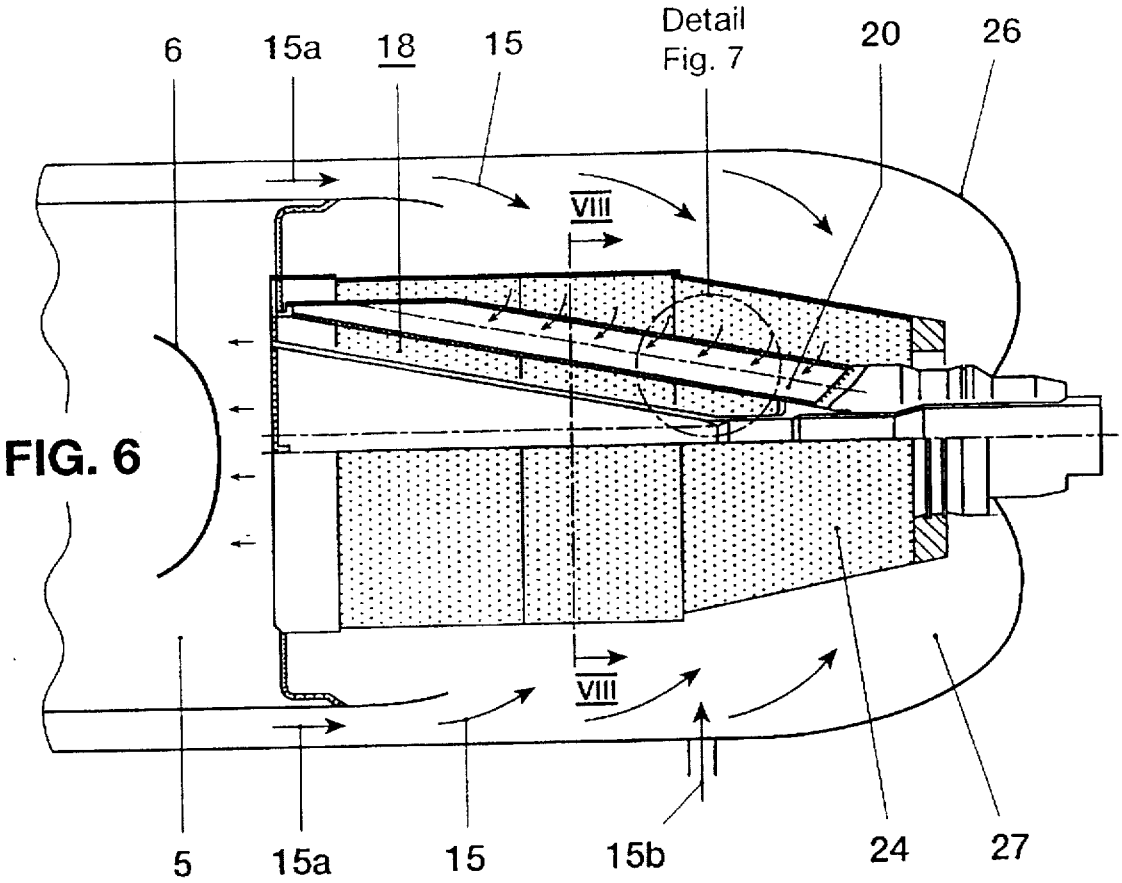
FIG. 6 shows a partial longitudinal section of the premix burner according to FIG. 2 having the flow rectifier according to the invention.

According to FIG. 6, the burner 18 described above is surrounded by a hood 26 which forms a plenum 27 for the combustion air 15 flowing to the burner. Here, the combustion air 15 is composed of the cooling air 15*a* on the one hand, which has convectively cooled the walls of the combustion chamber 5 beforehand, and of the air 15*b* on the other hand, which likewise flows into the plenum 27 via a bypass line (not shown) so that additional vorticity arises.

Therefore a very complex flow situation exists in the hood 26. Thus, according to the prior art, no uniform inflow of the air 15 through the tangential air-inlet slots 19, 20 into the burner is guaranteed, so that the gaseous fuel 13 and the combustion air 15 cannot be optimally mixed, which makes the use of the burner impossible under unfavorable imposed-flow conditions or does not reduce the NOx values sufficiently under more favorable outflow conditions.

Figure 7:
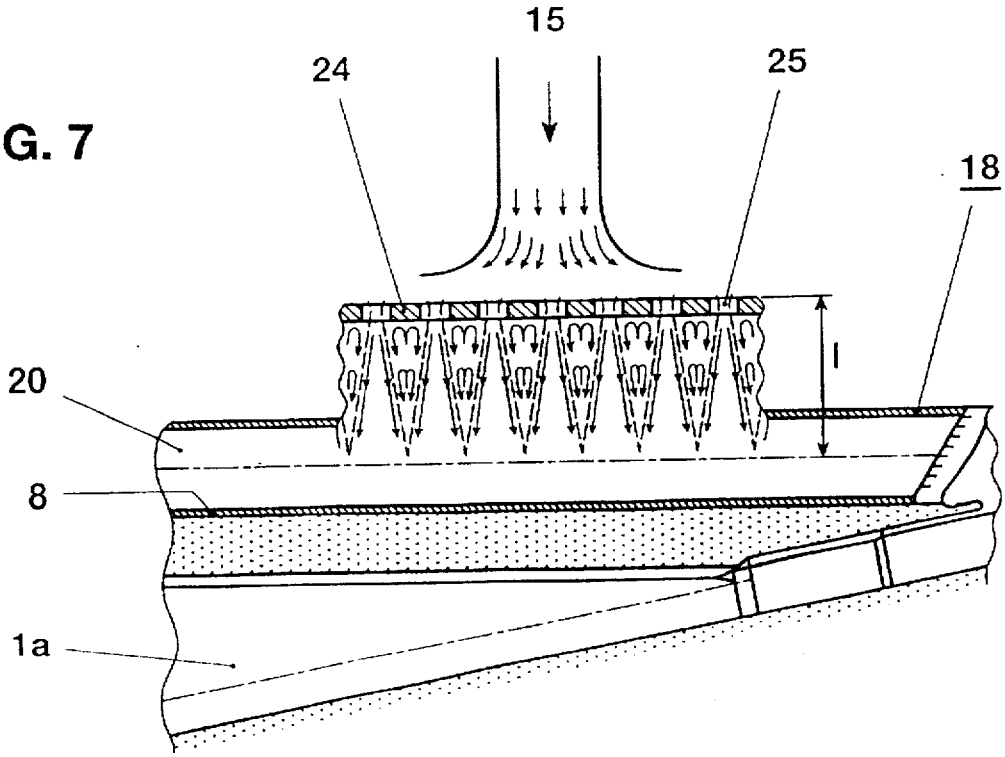
FIG. 7 shows a detail sketch of the mode of operation of the flow rectifier when flow is imposed at an angle according to FIG. 6.

Therefore a perforated basket 24, as shown in FIGS. 6, 7 and 8, is placed around the burner 18 subjected to radial flow, which basket 24 rectifies the flow. A contour adaptation of the basket 24 makes it possible to optimize the flow imposed on the burner. The flow imposed on the burner is uncoupled from the complex flow situation in the hood by the invention.

The area ratio between the through-flow area of the perforated basket 24 and the inflow area to the burner 18 (air-inlet slots 19, 20) is 4 in the exemplary embodiment shown. Thus the pressure loss across the perforated basket corresponds approximately to a dynamic pressure. If the through-flow area, i.e. the area of the openings 25 in the basket 24, were substantially smaller under otherwise constant conditions, an excessive pressure loss would develop.

Since the ratio of wall thickness s to hole diameter d has to be greater than/equal to 1, preferably 1.5, the distance t between the openings 25 is established by this requirement in addition to the aforesaid area ratio, which distance t in turn determines the flow profile behind the perforated basket 24. The air 15, as already described above, is split into small defined jets when flow occurs through the basket 24, which jets reunite behind the opening 25 after the running length l. The common flow profile can therefore be exactly established and matched to the respective burner requirements. The advantage consists in the fact that a non-uniform air distribution along the inflow length of the burner 18 can be rectified in terms of both mass distribution and flow profile. Consequently, the fuel can be optimally proportioned along the air inlet in the burner 18, as a result of which, apart from the turbulence increase in the air, the mixing of fuel and combustion air is improved and the pollutant emissions are thus reduced. The burner may therefore also be used under unfavorable imposed-flow conditions. In addition, an optimum local flow imposed on the burner becomes possible by a contour adaptation of the basket 24.

The invention is of course not restricted to the exemplary embodiment just described. FIG. 9 therefore shows a further exemplary embodiment which relates to a premix burner 18 subjected to axial flow. The combustion air 15 flows here out of the plenum 27 through the openings 25 of a perforated wall 24 into the burner 18, which perforated wall 24 is arranged in front of the burner perpendicularly to the direction of flow and may, for example, be a perforated plate. The fuel 13 is intermixed in the burner in a radially offset manner in front of the swirl body 28. To stabilize the system, pilot fuel 29 is directed into the burner via a central feed. Since the air flow is evened out by the wall 24 and in addition the small-scale turbulence level after the wall 24 is increased, homogeneous mixing of fuel and combustion air can take place, which leads to the aforesaid advantages.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. In a premix burner in which a plenum is arranged upstream of the burner inlet in the direction of flow, wherein fuel is mixed with the combustion air as it flows through the burner, the invention comprising:

a perforated component disposed in the plenum upstream of the combustion air inlet, said perforated component having a predetermined wall thickness (s) and being perforated with a multiplicity of openings having a predetermined diameter (d), the openings being mutually spaced at a predetermined distance (t), wherein said component is disposed so that combustion air flows through said component into the burner inlet, wherein said component splits the combustion air flowing therethrough into small defined jets which reunite after a certain running length (l) into a uniform air inlet flow, wherein a ratio of the wall thickness (s) to the diameter (d) of the openings is at least one, and wherein a ratio of a total through flow area of the perforated component and a burner inlet flow area is at least one.

2. The premix burner as claimed in claim 1, wherein the combustion air inflow is radially directed, and wherein the perforated component is a perforated basket arranged around the burner.

3. The premix burner as claimed in claim 1, wherein the combustion air inflow is axially directed, and wherein the perforated component is a perforated wall arranged in front of the burner and oriented perpendicularly to the direction of flow of the combustion air.

4. The premix burner as claimed in claim 1, wherein a ratio of running length (l) to the distance (t) between the openings is at least 5.

5. The premix burner as claimed in claim 1, wherein the ratio of wall thickness (s) to the diameter (d) of the openings is 1.5.

6. The premix burner as claimed in claim 3, wherein the ratio between the total through-flow area of the perforated wall and the inflow area to the burner is equal to one.

7. The premix burner of claim 1, wherein the burner is a double-cone type burner comprising two cone sectional bodies which define a conical interior space, the bodies being radially offset to form longitudinally extending air inlet slots through which the combustion air flows tangentially into the burner interior space, wherein the perforated component is a perforated basket disposed around the burner, and wherein a ratio between the total through-flow area of the perforated basket and an inflow area of the air inlet slots is greater than one.

8. The premix burner of claim 7, wherein the ratio between of the total through-flow area of the perforated basket and the inflow area of the air inlet slots is four.

* * * * *